US005287597A

United States Patent [19]

Mondini et al.

[11] Patent Number: 5,287,597

[45] Date of Patent: Feb. 22, 1994

[54] APPARATUS FOR COLLECTING LAP PIECES FROM A COMBING MACHINE

[75] Inventors: Giancarlo Mondini, Winterthur; Andreas Jorg, Neftenbach, both of Switzerland

[73] Assignee: Reiter Machine Works, Ltd., Winterthur, Switzerland

[21] Appl. No.: 887,539

[22] Filed: May 22, 1992

[30] Foreign Application Priority Data

May 22, 1991 [CH] Switzerland ..... 01515/91-8

[51] Int. Cl.[5] ..... D01G 19/00

[52] U.S. Cl. ..... 19/115 B; 19/215

[58] Field of Search ..... 19/115 R, 215, 218, 19/115 A, 115 B, 225, 65 A; 406/168, 127, 191, 117

[56] References Cited

U.S. PATENT DOCUMENTS

| | | | |
|---|---|---|---|
| 1,369,176 | 2/1921 | Johnson . | |
| 1,613,672 | 1/1927 | O'Grady | 19/115 R |
| 4,996,747 | 3/1991 | Wichtermann et al. | 19/115 R |
| 5,027,475 | 7/1991 | Mondini et al. | 19/115 R |
| 5,060,346 | 10/1991 | Bischofberger et al. | 19/225 |
| 5,095,586 | 3/1992 | Wüst et al. | 19/115 R |

FOREIGN PATENT DOCUMENTS

| | | | |
|---|---|---|---|
| 0368059 | 5/1990 | European Pat. Off. . | |
| 0370340 | 5/1990 | European Pat. Off. . | |
| 0437807 | 7/1991 | European Pat. Off. . | |
| 1815921 | 12/1968 | Fed. Rep. of Germany . | |
| 1530463 | 5/1968 | France . | |
| 312397 | 5/1929 | United Kingdom | 19/115 B |
| 0912227 | 12/1962 | United Kingdom . | |
| 1244310 | 8/1971 | United Kingdom | 19/218 |

*Primary Examiner*—Clifford D. Crowder
*Assistant Examiner*—Michael A. Neas
*Attorney, Agent, or Firm*—Francis C. Hand

[57] ABSTRACT

In addition to removing noil from a combing machine, the lap pieces which occur during a lap change operation are suctioned off and recycled into the combing process so as to reduce the amount of waste generated by the combing process. The noil and lap pieces can be removed from the combing heads through a common suction tube and conveyed separately via connecting pipes to separate points. The lap pieces which have been separated can be transported into a drum separator with the fiber material of the lap pieces being separated and recycled for the production of new laps.

14 Claims, 6 Drawing Sheets

APPARATUS FOR COLLECTING LAP PIECES FROM A COMBING MACHINE

This invention relates to an apparatus and method of collecting lap pieces from a combing machine.

As is known, in conventional combing machines, lap sheets from laps are unwound and combed out in a plurality of combing heads. When the lap sheet from a lap in a combing head has almost completely run out, then a lap change is carried out, either in all the combing heads or in a group of the combing heads of the machine simultaneously. An automatic lap change of this type by means of a control device is known, for example, as described in Swiss Patent 676,249 and corresponding EPA 0 388,059, with which the lap sheets which are running out in the combing heads are severed at the same height and new laps are supplied. In this way, the new lap sheets are drawn out and likewise severed at the same height. The cut off lap pieces from the lap sheets which are running out and from the new lap sheets are removed by means of suction nozzles.

However, in operations as described above, as the pieces of lap which are removed from the combing machines substantially consist of good fibers, this material is wasted.

Accordingly, it is an object of the invention to reduce the waste coming from a combing machine operation.

It is another object of the invention to be able to recycle the waste from a combing machine.

It is another object of the invention to reduce the expense of a combing machine operation.

Briefly, the invention provides an apparatus and method for the collection of lap pieces from a combing machine.

The apparatus is employed with at least one combing machine having a plurality of combing heads and a plurality of conduits, each of which is disposed relative to a combing head to receiving noil combed from a lap during a combing operation. In this respect, the apparatus employs a plurality of suction nozzles, each of which is disposed relative to a combing head to receive lap pieces severed from a lap during a lap changing operation. In addition, a collecting pipe is connected in common to each suction nozzle of the combing machine for receiving the lap pieces therefrom. Still further, a fan and fiber separator is connected to the collecting pipe downstream of the suction nozzles relative to a flow of lap pieces in the collecting pipe while a shut-off means is disposed between the suction nozzles and the collecting pipe for selectively opening and closing the suction nozzles relative to the collecting pipe.

The method of the invention resides in the steps of removing noil from a lap being combed in a respective combing head during a combing operation and of thereafter separately removing a lap piece severed from a lap during a lap change operation.

In accordance with one embodiment of the invention, each combing machine includes a branch pipe which is connected to the suction nozzles thereof in order to convey the collected lap pieces to the collection pipe. In this case, the shut off means is disposed in the branch pipe. In this way, the shut off means provides a common means for a controlled removal of the lap pieces for each combing head with an appropriate dosing of such in performance.

Each combing machine is also provided with a control device to open a shut-off means of the combing machine to allow drawing off of the lap pieces. In order to coordinate the removal operations of the individual combing machines, one after the other, the control devices of the individual combing machines communicate with each other. This can be effected through a central computer system, for example. The coordination between the individual control units of the combing machines is required for the reason that the subsequent transport system or the collecting pipe is only laid out for a predetermined transport capacity. That is, the suction air stream must be sufficiently large for the individual combing machines to ensure faultless removal of the lap pieces.

It is an advantage when every combing machine is provided with a suction tube which is connected to the suction nozzles of the machine via a pipe. With this, the suction tube can have an air inlet opening on one end while whereby a branch pipe is connected to the opposite end.

As noted above, the lap pieces and the noil are disposed of or removed separately. Through this, the waste products resulting in the machine, all of which are qualitatively different, are each fed in each case to a specific purpose ear-marked for this waste product alone. That is, there is no "waste" in the accepted sense, rather the waste is recycled to suit special purposes.

As the separated lap pieces consist substantially of good fibers, the lap pieces are returned to the blowing room line usually disposed upstream of the combing machines. With this, the lap pieces can be fed to a mixer or also positioned in bale form on an opening machine. The noil component, which mainly consists of good fibers, is fed to a collecting point. At this collecting point, the noil can be compressed, packed or prepared for further transport in some other way. The noil packed in this way can be sold to another spinning mill which has a processing line for the further processing of noil.

As the noil is mainly a matter of short fibers, the noil can be used for the production of low grade textile which do not demand higher quality standards. Such short fibers can be spun very well on motor spinning machines which operate in accordance with an open-end spinning process.

Insofar as a spinning mill is equipped with one or more further spinning process lines, which are not provided with combing and which have open-end spinning machines, the noil can be fed directly to the process lines of the further spinning process lines of the blowing room.

A further possibility for the separate removal of the lap pieces is to have removal of the lap pieces and the noil take place at different times. Through this, is possible to remove the lap pieces and noil initially, with a common transport system and, subsequently, with a separate transport system. The result of this is that the number of transport systems which is necessary, e.g. conveying tubes, particularly in the area of the combing machine, can be kept to a minimum.

Through this, the combing machines are not constructed unnecessarily with transport systems and the access to the combing machines, particularly for service work, remains unobstructed.

According to the working cycle on the combing machine, the selection of the transport systems is undertaken by the control unit of the combing machine. The individual control units of the combing machines are thereby connected with a central computer which coordinates the removal on the individual combing machines with each other.

For the implementation of the method, the suction conduits for the noil and the suction nozzles for the lap pieces merge in a common suction tube whereby a junction means is provided in the suction tube for the division of the connecting routes of lap pieces and noil.

It is advantageous when the junction means, or a displacement device (such as a flap valve) for the junction means, are set from the control unit of the respective combing machine.

Following the junction means, the transport conduits are permanently assigned to the material to be removed. Through this, errors in the transport of material are avoided.

These and other objects and advantages of the invention will become more apparent from the following detailed description taken in conjunction with the accompanying drawings wherein.

Figure 1:
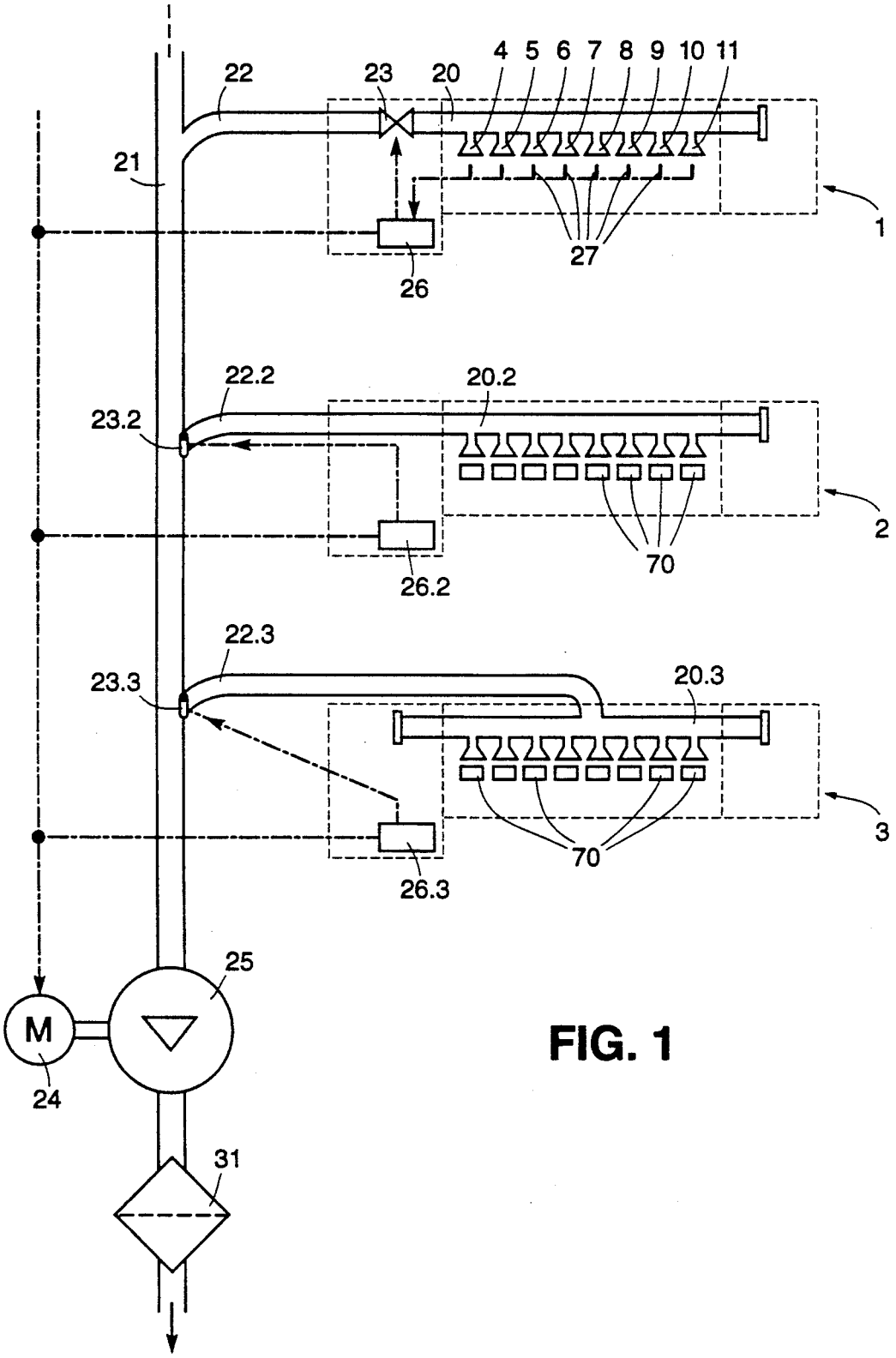
FIG. 1 illustrate a block diagram of an apparatus for the collection of lap pieces from a combing machine in accordance with the invention.

Referring to FIG. 1, a plurality of combing machines 1, 2, 3 are shown connected to a common collecting pipe 21 for the collection of lap pieces. However, it is to be noted that any number of combing machines, for example, from about four to eight combing machines may be connected to a common collectin pipe 21.

Each combing machine 1, 2, 3, contains several combing heads, e.g. eight combing heads, in which a lap sheet is wound off and combed from a lap. When a lap is nearly finished, then a lap change is carried out. With this, the lap sheet is severed on a predetermined position, the lap piece separated is removed and a new lap is placed in position. The lap sheet from the new lap is likewise severed on a predetermined position and then the start of the new lap sheet is joined to the end of the old lap sheet.

Figure 2:
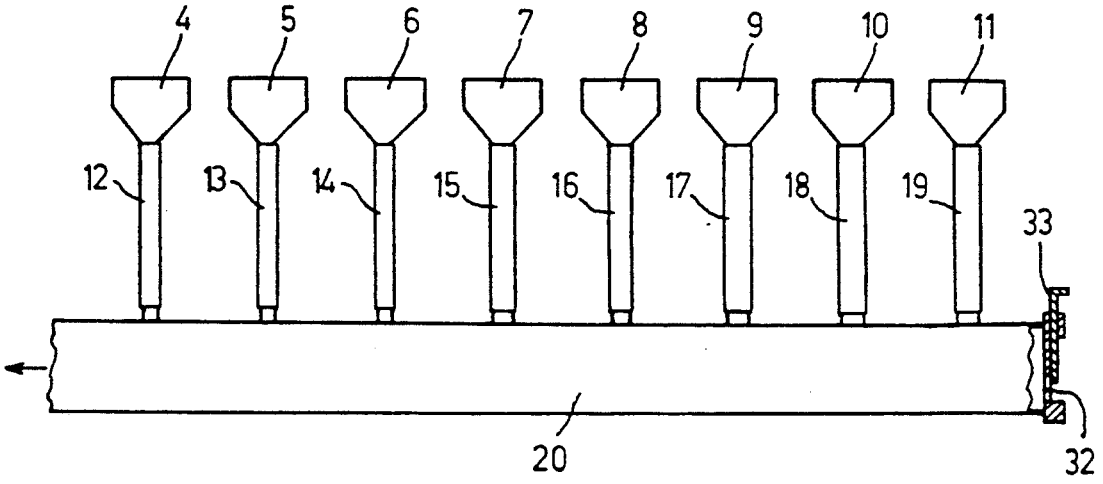
FIG. 2 illustrate a schematic view of a plurality of suction nozzles connected to a common suction tube in accordance with the invention.

Each combing machine has a suction nozzle for the removal of the separate lap pieces. For preference, each combing head has its own suction nozzle, for example, the entire combing machine has eight suction nozzles 4, 5, 6, 7, 8, 9, 10, 11. As shown in FIG. 2, these suction nozzles are each connected via a pipe 12, 13, 14, 15, 16, 17, 18 or 19 to a suction tube 20 which extends through the entire combing machine.

The suction tubes 20, 20.2, 20.3 of the combing machines 1, 2, 3 are connected with the collecting pipe 21 via a branch pipe 22 or 22.2 or 22.3, with a shut off means 23 arranged in each case at any desired position between the suction tube 20 and the collecting pipe 21.

The shut-off means 23 may be disposed between the suction tube 20 and the branch pipe 22 as indicated for the first combing machine 1 and may be in the form of a valve. Alternatively, the shut off means 23 may be in the form of a flap 23.2, 23.3 and may be disposed at the point where a branch pipe 22.2, 22.3 opens into the collecting pipe 21 as shown for the combing machines 2, 3.

The collecting pipe 21 leads to a fan and a fiber separator 25 driven from a motor 24. The fiber separator 25 can well be a conventional drum separator. Each combing machine has a control device 26 or 26.2 or 26.3 for the automatic execution of a lap change. In addition, sensors 27, e.g. photoelectric cells, are arranged at the combing heads (only represented in the machine 1) to give a start signal to the control device when the lap sheet on one of the combing heads has almost completely run out. When such a start signal appears in one of the machines, e.g. in the machine 1, then the control device 26 interrupts the operation of all the combing heads (or a group of the combing heads) of the machine 1 and opens the shut off means 23 assigned. At the same time, the control devices 26.2, 26.3 of the remaining machines are locked, so that a lap change cannot be carried out whilst the lap change in machine 1 is taking place.

The lap change is then carried out in the known way by the control device 26. Firstly, in all combing heads (or in a group of the combing heads), the lap sheets are severed at a predetermined position, for instance between one lap roller 28 (FIG. 3) on which the lap 29 is lying and a pair of transport and calendar rollers 30 for the lap sheets W. The laps 29 are then turned again, the driving motor 24 of the fan and drum separator 25 is switched on and the lap sheet residues remaining on the lap 29 are sucked to the suction nozzles 4–11, which are arranged between the running paths of the lap sheets, for instance, between the lap rollers 28 and the transport rollers 30. After this, the driving motor 24 can be switched off again temporarily.

Following this, the empty lap tubes are removed from a transport system (not shown), and new laps are placed in position. The driving motor is switched on again, if it has been switched off, the new laps are turned slightly, the lap sheets coming from the new laps will be severed in a predetermined place and the lap pieces severed are sucked into the suction nozzles 4–11. Subsequently, the starts of the new lap sheets are joined to the ends of the old lap sheet, the control unit 26 puts the combing heads back into operation, closes the shut-off organ 23 and releases the locking of the other control units 26.2, 26.3.

Figure 3:
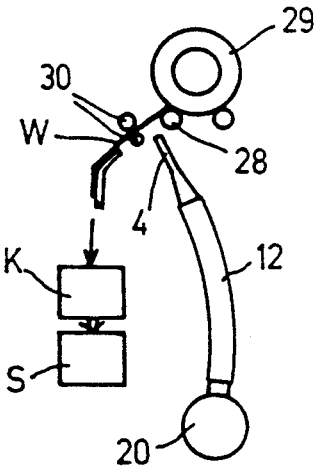
FIG. 3 illustrates a side view of a combing machine arrangement in accordance with the invention.
Figure 9:
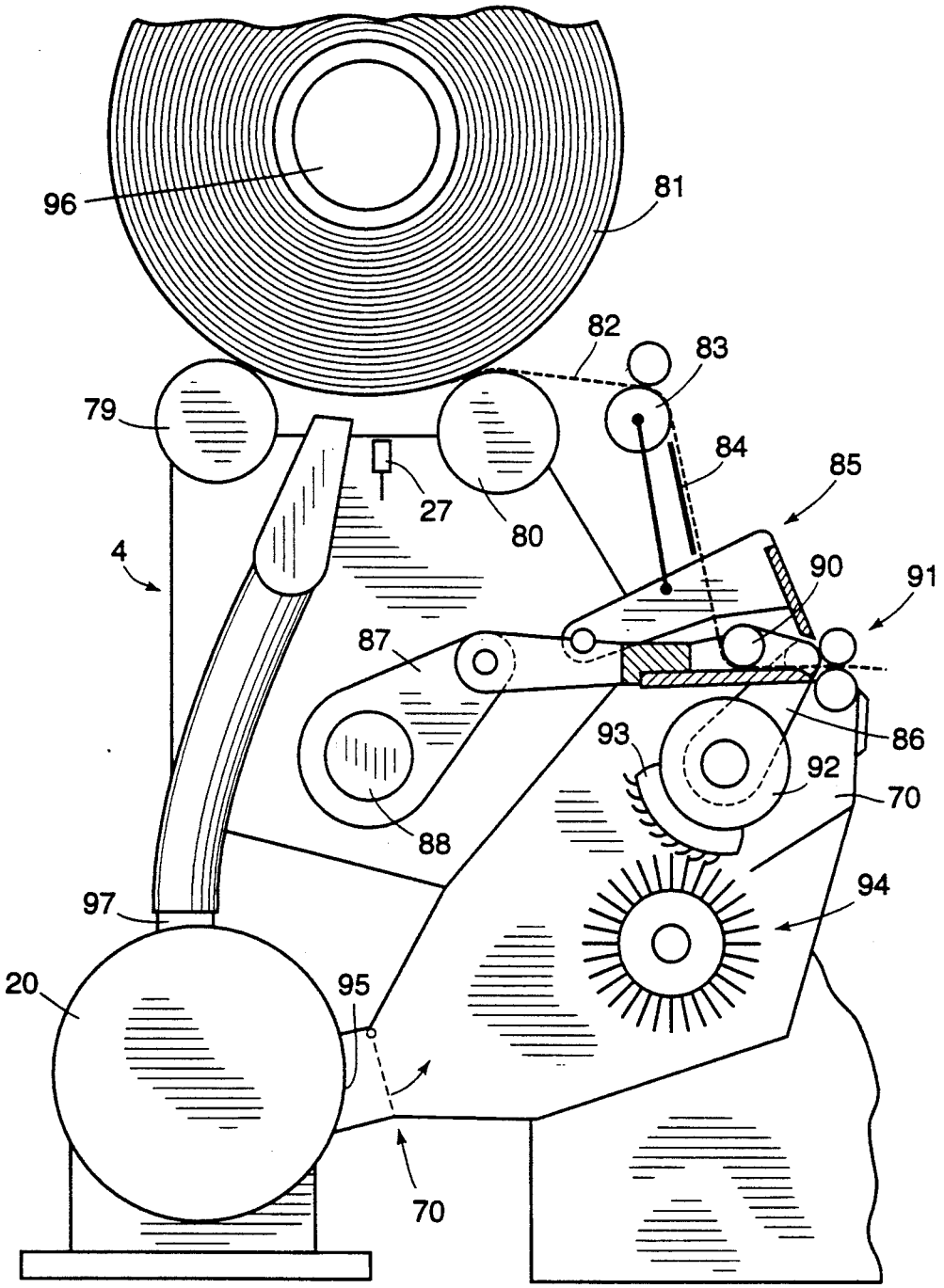
FIG. 9 illustrates a schematic side view of a combing head of a combing machine constructed in accordance with the invention.

FIG. 3 also shows combing elements K, in which, in operation, feed the lap sheet to each combing head, conduit 70 leading from the combing elements and a suction device S assigned with the combing elements K and conduit 70 for the removal of noil occurring during the combing. Further, details of such an arrangement are shown in FIG. 9.

The lap piece residues separated during the lap change and sucked in by the suction nozzles 4–11 arrive at the drum separator 25 via the collecting pipe 21. The fiber material of the lap pieces can be taken from the drum separator 25 for recycling (with the production of new lap). Naturally, for this purposes, the suction nozzles 4–11 must be connected with the collecting pipe 21 as described, and separated from the suction devices S (FIG. 3) used in conventional combing machines for the noil.

The current of transport air sucked from the fan and drum separator 25 through the collecting pipe 21 is exhausted into the surrounding after the separation of the fibers through a dust filter 31 (see FIG. 1) or into a central filter installation or air conditioning installation.

On some embodiments, the suction nozzles 4–11, are arranged to be movable in the combing machine and are moved in the lap changing operation. In order to make such movements possible, the pipes 12–19 can expediently be formed as flexible hoses, in particular pliable hoses, or which contain hoses.

In order that the described suction of lap pieces and the transport of the fiber material into the drum separator 25 function correctly, an adequate velocity of the suction and transport air is required at all points. A first condition for this is given in that, as described, never more than one combing machine or suction tube 20 is connected with the collecting pipe 21 via an open shut-off means 23 or 23.2 or 23.3. When the branch pipe 22 or 22.2, as represented in the combing machines 1 and 2, is connected to one end of the suction tube 20 or 20.2 then a further requirement is the provision of an air inlet opening 32 (FIG. 2) on the other end of the suction tube 20. The size of this air inlet opening 32 can be fixed or adjustable by means such as an air shutter 33.

Figure 4:
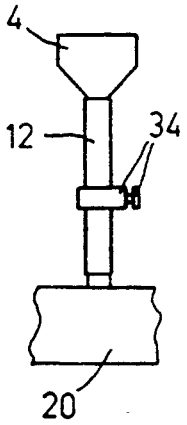
FIG. 4 illustrates a modified view of a connection between a suction nozzle and a suction tube employing a restrictor in accordance with the invention.
Figure 5:
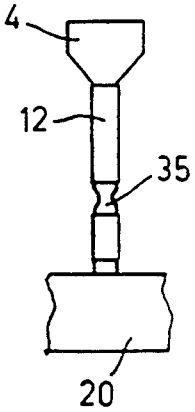
FIG. 5 illustrates a view similar to FIG. 4 with a modified restrictor in accordance with the invention.
Figure 6:
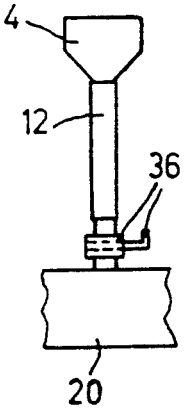
FIG. 6 illustrates a view similar to FIGS. 4 and 5 of a further modified restrictor.

In order that approximately the same relationships predominate in all the suction nozzles 4–11, the pipes 12–19 can have cross sections which reduce from the air inlet opening 32 to the connection of the branch pipe 22. For example, the pipes 18 and 19 can have a diameter of 80 millimeter (mm) and the pipes 15, 16 and 17 can have a diameter of 70 millimeters (mm). However, pipes can also be used which all have the same cross section, which, however, contain restrictors with different throttle effects. For example, FIG. 4 shows an adjustable clamp 24 on the pipe 12 formed as a flexible hose, which forms a restrictor by pressing the hose together. According to FIG. 5, there is a restrictor 35 in the pipe 12, the throttle effect of which can be different with various pipes. FIG. 6 shows an adjustable air shutter 36 arranged as a restrictor in the pipe 12.

Figure 7:
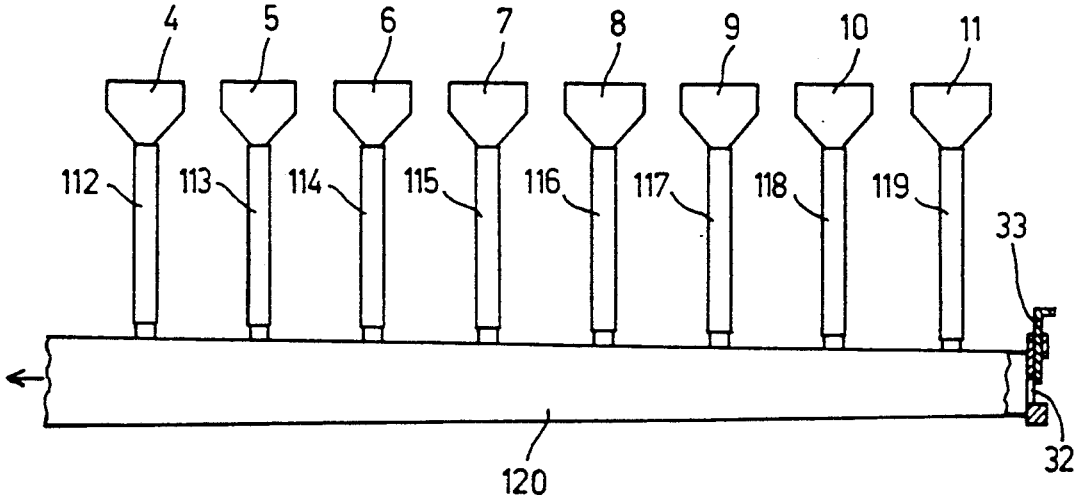
FIG. 7 illustrates a view similar to FIG. 2 of a modified suction tube in accordance with the invention.

Referring to FIG. 7, another possibility for providing nearly the same relationships in all the suction nozzles 4–11 exists in that a suction tube 120 is used which has a cross section the size of which increases in steps or gradually from the air inlet opening 32 to the connection of the branch pipe 22 as represented in FIG. 7. With this suction tube 120, the pipes 112–119 can all have equally large cross sections. Also, the cross section of the pipes 112–119 could be slightly different, in order to provide additional support for the compensation effect.

Naturally, the connection of the branch pipe is possible otherwise than to one end of the suction tube; for example, in the combing machine 3, the branch pipe 22.3 is connected between the ends of the suction tube 20.3. In this case, it is expedient to provide an air inlet opening on both ends of the suction tube 20.3, similarly to the air inlet opening 32 shown in FIG. 2.

Figure 8:
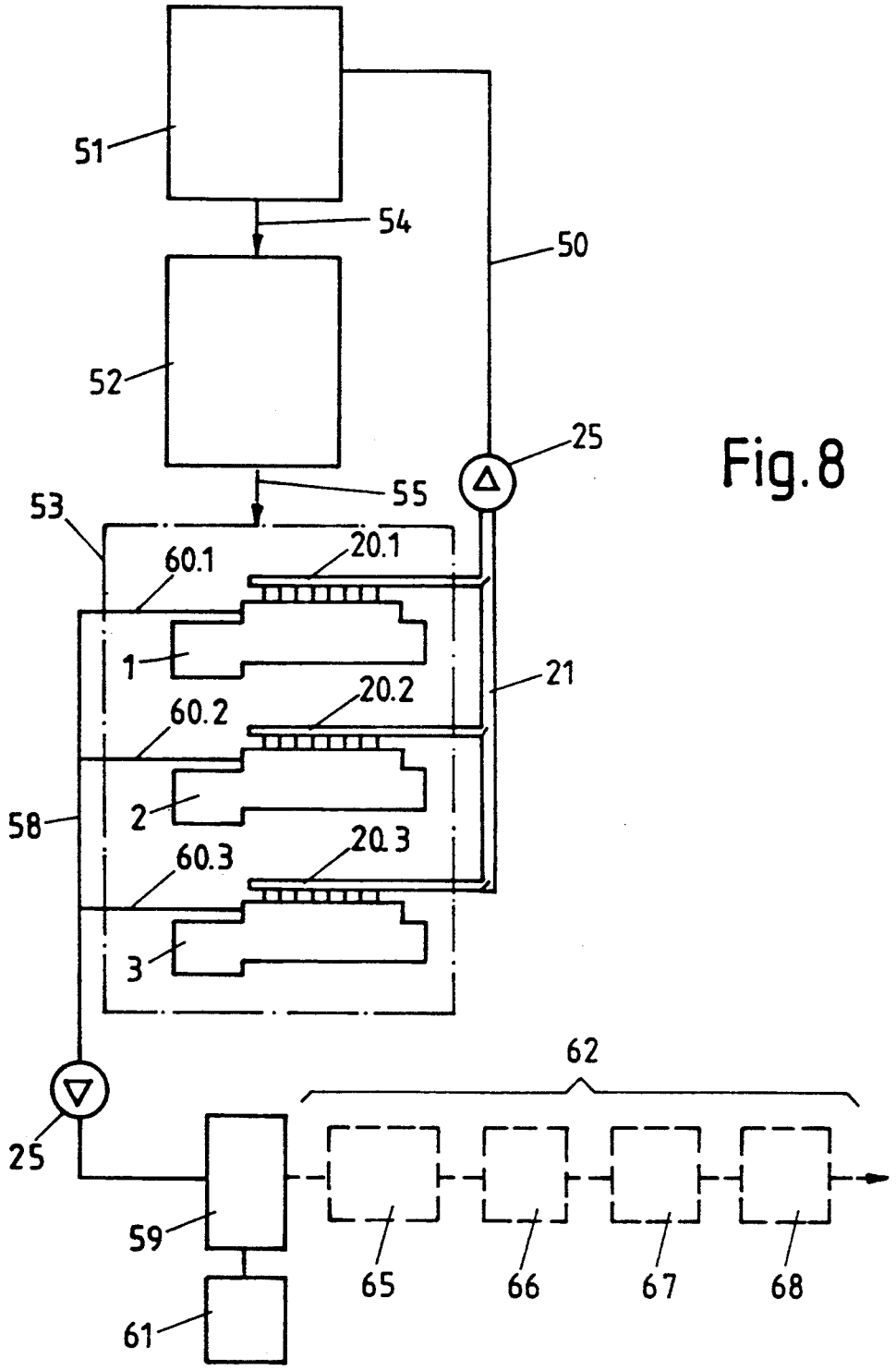
FIG. 8 illustrates a schematic plan view of a spinning line constructed in accordance with the invention.

FIG. 8, wherein like reference characters indicate like elements as above, shows a schematic view of a spinning line, which for reason of clarity, is only shown up to the combing machines, 1, 2 and serves for the schematic representation and explanation of the method of disposal of the lap residues or noil components from the combing machine. The further representation the subsequent drawing passages and spinning machines after the combing machines 1, 2, 3 has been omitted.

As described above with respect to FIG. 1, the lap pieces, sucked out via the branch pipes 22, 22.2, 23.3 reach a drum separator 25, via a collecting pipe 21 through the action of a fan, from which the collected material is further transferred to a conveyor pipe 50, which feeds the lap pieces back into the process to a machine of a blowing room line 51 interposed upstream of one of the combing machines. The blowing room line 51, which, as a rule, consists of opening, mixing and cleaning elements is only represented schematically.

A preparation line 52 which is subsequently added to the blowing room line 51, is likewise only represented schematically for reasons of clarity. The preparation line 52 consists mainly of cards, draw frames as well as lap machines which form the laps which serve as the feed for the combing machines 1, 2, 3.

The material flow between the individual process stages, i.e. blowing room line 51, preparation line 52 and a combing line 53 are represented schematically with the arrows 54 and 55.

The noil component is collected continuously at the individual combing machines 1, 2, 3, in the known way, by a suction system (not shown) and transferred to a common pipe 58 via the pipes 60.1, 60.2, 60.3. By means of this pipe 58, which is acted on by a current of suction air through a second drum separator 25, the noil component resulting is conveyed to a collecting point 59.

At this collecting point 59, the noil can be packet for dispatch by suitable packing devices 61, which are only indicated schematically, for the dispatch to other spinning mills.

Another possibility presents itself when the spinning mill itself is equipped with a process line 62 which makes possible the further processing of the noil under one roof. In FIG. 8, this possibility is represented as following the collection point 59 by means of blocks 65 to 68, shown by broken lines. With this, a blowing room 65, a card line 66 and a preparation line 67 are interposed before a rotor spinning machine line 68. The preparation line 67 consists thereby of one or more draw frame passages without combing lines. The rotor spinning machine process according to the open-end principle is particularly suitable, and is also suitable for processing fiber mixtures with a higher component of short fibers, e.g. noil. It should also be considered, that according to DE-OS 27 34 564, a fiber silver is formed from the noil on the individual combing machines 1–3, which is subsequently processed directly according to the open-end spinning process.

The admixture of the lap pieces or the noil as previously described in the blowing room process, is controlled and dosed according to predetermined process data by means of a control which is not represented in detail.

Through the separate disposal of noil and lap residues, and particularly the recycling of the lap pieces, the total productive capacity is increased.

Referring to FIG. 9, wherein like references indicate like parts as above, each combing head of a combing machine may be constructed in a conventional manner, for example, with a pair lap rollers 79, 80, on which a lap 81 lies for the unwinding of a lap sheet 82. The lap sheet 82 is diverted over a roller 83 and subsequently downwards over a guide plate 84 until reaching a nipper jaw unit 85, called a nipper for short. The nipper 85 leads over an oscillating arm 86, 87. and carries out an oscillating movement via a driving shaft 88. There is a feeding roller 90 inside the nipper 85, by means of which the lap is pushed intermittently in the direction of a detaching cylinder 91. Below the nipper 85, there is a circular comb 92 with a comb segment 93, which, with appropriate setting of the nipper in its rearmost oscillating position, a fiber tuft is clamped in the nipper, projects and is combed out. The components combed out through this comb segment 93, such as short fibers for example, also known as noil, are stripped through further turning of the circular comb 92 by a brush roller 94, arranged underneath the circular comb (as shown).

Through the under pressure (i.e. suction) predominating in a following conduit 70 which is produced by a fan 100 (FIG. 10), the stripped noil and other impurities are conveyed to a opening 95 of a suction tube 20.

The pipe of a suction nozzle 4 is connected to the tube 20 via a further opening 97, over which the lap pieces resulting from a lap change are likewise conveyed to the suction tube 20. A stationary sensor 27 is also fitted underneath the lap 81 for the detection of the surface of the tube 96 when the lap runs out.

In the same way, the described embodiment of a combing head, including the connection to the suction 20, is for example, present eight times on the combing machine.

Figure 10:
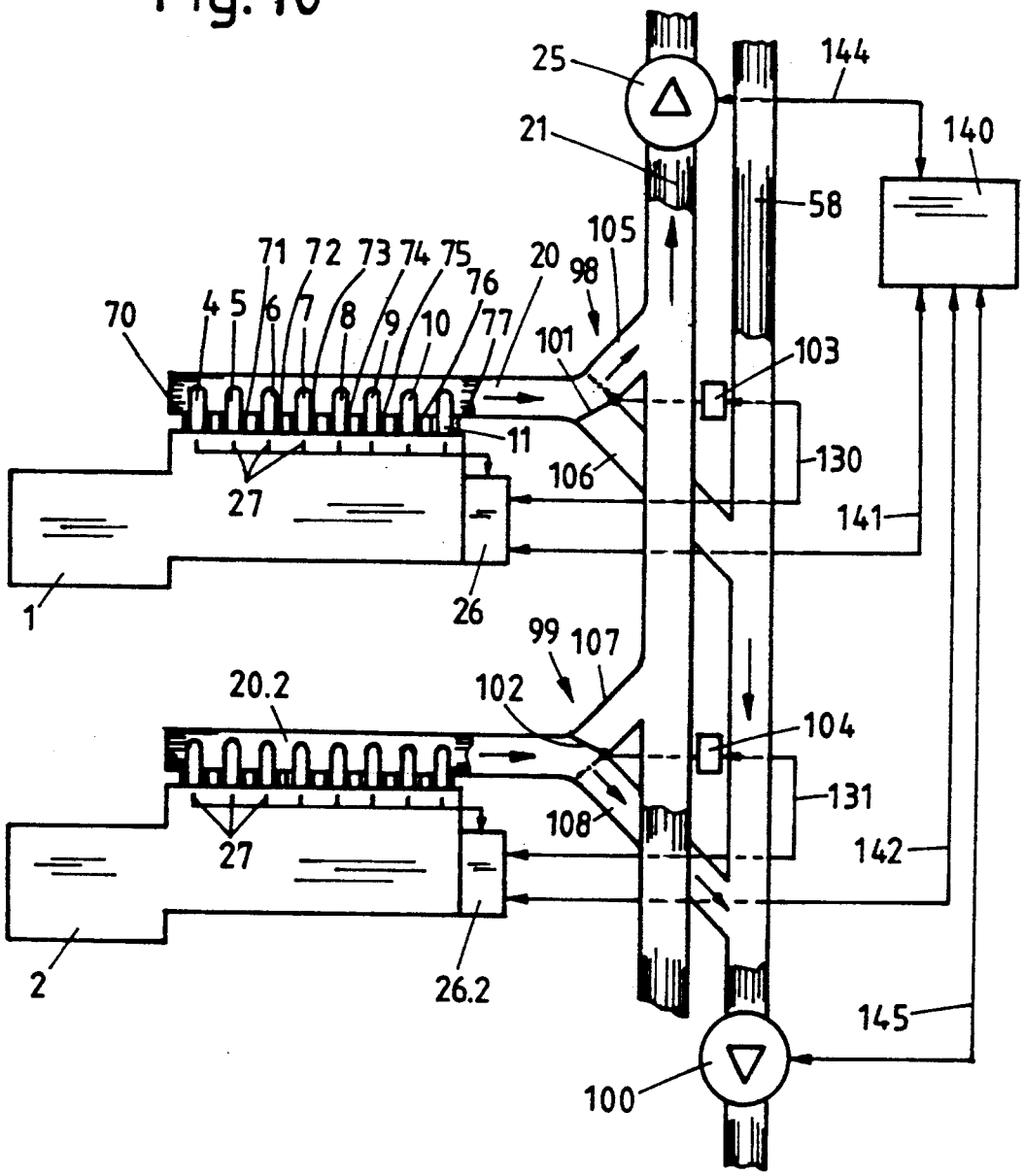
FIG. 10 illustrates a schematic plan view of an arrangement employing combing heads as shown in FIG. 9.

FIG. 10 shows a schematic top view of the entire combing machine 1, including a further combing machine 2, as well a part of the disposal pipes. The combing machine 1 is shown to a smaller scale, with which all the suction nozzles 4–11 are not shown, which merge via pipes into the suction tube 20. Likewise, the conduits 70–77, shown merging into the tube 20, are those for the disposal of the noil from the individual combing heads. The construction and details of the combing machine 2 correspond to the described combing machine 1, The suction tubes 20, 20.2 are provided with a junction means 98, 99 so as to be connected to the respective collecting pipes 21, 58 for the separate removal of noil and lap pieces. As indicated, a branch pipe 105 of the junction 98 of one combing machine 1 merges into the collecting pipe 21 for the removal of the lap pieces, whilst another branch pipe 106 merges into the collecting pipe 58 for the noil. The junction means 99 of the other combing machine 2 has a branch pipe 107 merging into the collecting pipe 21, and a second branch pipe 108 merging into the collecting pipe 58. The control devices 26, 26.2 are, in accordance with the example of FIG. 1, connected with the sensors 27 in the combing heads.

As illustrated, a flap valve 101, 102 is disposed in each junction means 98, 99 in order to selectively open and close a respective branch pipe to a respective collecting pipe. To this end, a setting element 103, 104 is connected to each flap valve 101, 102, respectively while the control devices 26, 26.2 are connected via leads 130, 131 with the setting elements 103, 104, and a central computer 140 via leads 141, 142.

This control unit 140 is connected via a lead 144 with the control of the fan 25 and via another lead 145 with the control of the fan 25 and via another lead 145 with the control of the fan 100.

The following of this embodiment is now explained as follows:

In the position shown, a lap change is directly taking place after the sensors 27 have reported the running out of the tubes 96 to the control device 26. As no other combing machine is undertaking a lap change at this time, the control device 26 does not receive a locking signal from the control unit 140 via the lead 141. The combing machine 1 is now stopped, whereby no further noil can be fed into the conduits 70 to 77. As the fan 100 continues in operation and the flap valve 101 is still in the position shown with broken lines, the noil which is still in the suction tube 20 is entirely conveyed over the branch pipe 106 into the collecting pipe 58. The suction tube 20 is now empty.

Now, that is to say, after a short time delay until the tube 20 is completely empty, the changing operation of the lap is initiated through a signal of the control device 26. Firstly, the flap 101 is swivelled into the position shown by means of the setting element 103, whereby the branch pipe 106 is closed and the branch pipe 105 is opened to the collecting pipe 21. Whether the flap 101 has actually reached its final position can be additionally supervised by sensors (not shown). The control unit 140 now receives a report from the control device 26 that the flap 101 has been reset and the changing operation will take place directly. The control unit 140 now activates the fan 25 or checks whether the fan 26 is in operation.

The actual lap change is now undertaken and the lap pieces which result are sucked out by the suction nozzles 4–11. The lap pieces reach the suction tube 20 through the suction which is produced by the fan 25 and reach the collecting pipe 21 via the branch pipe 105, from which they are conveyed via further transport pipes connected to the fan 25 and are conveyed to the processing line again, e.g. of the blowing room and are fed in there.

When the changing of the lap is finished, and the disposal of the lap pieces for the preparation of the end of the lap which is running out has been undertaken, and the preparation for the start of the new lap has been carried out, then, even before the combing process begins, the flap 101 is swung back into the position shown with broken lines. The way is again open for the disposal of the noil into the collecting pipe 58.

The period of time between the new start of the combing machine 1 or the combing process and the disposal of the lap pieces is sufficient, so that the lap pieces from the suction tube 20 can reach the collecting pipe 21, before the flap 101 is reversed.

When necessary, the fan 25 can again be stopped via the control unit 140 insofar as the further transport of the lap pieces to the recycling has already been concluded. During the lap change on the combing machine 1, the combing machine 2 remains in the normal combing process, with which noil is removed by the branch pipe 108 to the collecting pipe 58. As in the previously embodiment, the noil is likewise removed to a collection point, for example. The fan 100 is continuously in operation, whilst the fan 25 can also be stopped intermediately, according to the change periods.

The openings 95, 97 (see FIG. 9) could also be provided with flaps which can be closed, (partially shown with broken lines), which, according to the removal of lap residues or noil, are opened or shut. This is necessary when the required current of suction air is insufficient for the appropriate suction removal operation of lap residues or noils.

The invention thus provides an apparatus and method for the recycling of fiber material which would otherwise be wasted in a combing operation. Accordingly, the total output of a combing machine can be increased.

What is claimed is:

1. In combination a plurality of combing machines, each combing machine having a plurality of combing heads; a plurality of conduits, each conduit being disposed relative to a respective combing head to receive noil combed from a lap during a combing operation; and a plurality of suction nozzles, each suction nozzle being disposed relative to a combing head to receive lap pieces severed from a lap during a lap changing operation;

a collecting pipe connected in common to said combing machines and to said suction nozzles of said machines to receive lap pieces therefrom;

a plurality of shut-off means, each shut-off means being connected between said suction nozzles of a respective combing machine and said collecting pipe for selectively opening and closing said suction nozzles relative to said collecting pipe;

a control device to open said shut-off means of one of said combing machines while maintaining said shut-off means of the other of said combing machines closed whereby to allow delivery of lap pieces to said collecting pipe from only one combing machine at a time; and a fan and separator connected to said collecting pipe downstream of said suction nozzles relative to a flow of lap pieces in said collecting pipe.

2. In combination at least one combing machine having a plurality of combing heads; a plurality of conduits, each conduit being disposed relative to a combing head to receive noil combed from a lap during a combining operation; a plurality of suction nozzles, each suction nozzle being disposed relative to a combing head to receive lap pieces severed from a lap during a lap changing operation; a plurality of pipes, each said pipe being connected to a respective suction nozzle, and a suction tube having said pipes connected thereto in parallel;

a branch pipe connected to said suction tube to convey lap pieces therethrough from said suction tube;

a collecting pipe connected to said branch pipe to receive lap pieces therefrom;

a shut-off means in said branch pipe for selectively opening and closing said suction nozzles relative to said collecting pipe; and a fan and fiber separator connected to said collecting pipe downstream of said suction nozzles relative to a flow of lap pieces in said collecting pipe.

3. The combination as set forth in claim 2 wherein said suction tube has an air inlet at at least one end.

4. The combination as set forth in claim 3 wherein said suction tube is connected at one end to said branch pipe.

5. The combination as set forth in claim 4 wherein said suction tube is of increasing cross-sectional area from one end to said end connected to said branch pipe.

6. The combination as set forth in claim 4 wherein said pipes connected to said suction tube have cross-sections of reducing area from said air inlet towards said branch pipe.

7. The combination as set forth in claim 4 wherein each said pipe connected to a respective suction nozzle has a restrictor therein for restricting a flow of air therethrough.

8. The combination as set forth in claim 7 wherein each restrictor is adjustable.

9. The combination as set forth in claim 2 wherein each pipe connected to a suction nozzle is a flexible hose.

10. In combination at least one combing machine having a plurality of combing heads, a plurality of conduits, a plurality of suction nozzles, and a suction tube connected in common to said conduits and said suction nozzles, each conduit being disposed relative to a combing head to receive noil combed from a lap during a combing operation and each suction nozzle being disposed relative to a combing head to receive lap pieces severed from a lap during a lap changing operation;

a first collecting pipe for receiving lap pieces from said suction nozzles;

a second collecting pipe for receiving noil from said conduits;

a junction means having a first branch pipe connected between and to said suction tube and said first collecting pipe to convey lap pieces to said collecting pipe and a second branch pipe connected to and between said suction tube and said second collecting pipe to convey noil therethrough;

a flap valve in said junction means to selectively open and close a respective branch pipe to a respective collecting pipe; and a fan and fiber separator connected to said first collecting pipe downstream of said suction nozzle relative to a flow of lap pieces in said collecting pipe.

11. The combination as set forth in claim 10 including a plurality of said combing machines connected in parallel to said collecting pipe, and a plurality of said shut-off means, each shut of means being connected between said suction nozzles of a respective combing machine and said collecting pipe, each combing machine having a control device to open a shut-off means of said respective combing machine while maintaining said shut-off means of the other combing machines closed whereby to allow delivery of lap pieces to said collecting pipe from only one combing machine at a time.

12. The combination as set forth in claim 11 wherein each control device is connected to said flap valve of a respective combing machine to move said flap valve from one branch pipe of a respective junction means to the other branch pipe.

13. In combination at least one combing machine having a plurality of combing heads; a plurality of conduits, each conduit being disposed relative to a combing head to receive noil combed from a lap during a combing operation; a plurality of suction nozzles, each suction nozzle being disposed relative to a combing head to receive lap pieces severed from a lap during a lap changing operation;

a suction tube connected in common to said suction nozzles and said conduits;

a first collecting pipe for receiving noil from said suction tube;

a second collecting pipe for receiving lap pieces from said suction tube;

a junction means having a first branch pipe connected between and to said suction tube and said first collecting pipe to convey noil to said first collecting pipe and a second branch pipe connected between and to said suction tube and said second collecting pipe therethrough;

a shut-off means in said junction means for selectively opening and closing a respective branch pipe relative to a respective collecting pipe; and a fan and fiber separator connected to said second collecting pipe downstream of said suction tube relative to a flow of lap pieces in said second collecting pipe.

14. The combination as set forth in claim 13 which further comprises a fan and fiber separator connected to said first collecting pipe downstream of said suction tube relative to a flow of noil in said first collecting pipe.

* * * * *

UNITED STATES PATENT AND TRADEMARK OFFICE

CERTIFICATE OF CORRECTION

PATENT NO. : 5,287,597

DATED : Feb. 22, 1994

INVENTOR(S) : GIANCARLO MONDINI, et al

It is certified that error appears in the above-identified patent and that said Letters Patent is hereby corrected as shown below:

Column 2, line 53 after "this," insert -it-
Column 3, line 50 change "collectin" to -collecting-
Column 6, line 4 after "representation" insert -of-
Line 34, change "packet" to -packed- Column 10, line 39 change "of" to -off-
Column 11, line 4 after "pipe" insert -to convey lap pieces- Signed and Sealed this Twenty-second Day of November, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,287,597

DATED : February 22, 1994

INVENTOR(S) : Giancarlo Mondini, et al

It is certified that error appears in the above-identified patent and that said Letters Patent is hereby corrected as shown below:

Column 7, line 65, cancel "the control ... with"

Signed and Sealed this

Tenth Day of January, 1995

*Attest:*

Bruce Lehman

BRUCE LEHMAN

*Attesting Officer*

*Commissioner of Patents and Trademarks*